US006305047B1

(12) United States Patent
Armaly, Jr. et al.

(10) Patent No.: US 6,305,047 B1
(45) Date of Patent: Oct. 23, 2001

(54) SPONGE WITH GRIPPING SLOTS

(75) Inventors: John W. Armaly, Jr., Grosse Pointe Shores; Gilbert C. Armaly, Clarkston; William C. Young, III, Canton, all of MI (US)

(73) Assignee: Armaly Sponge Company, Walled Lake, MI (US)

( * ) Notice: Subject to any disclaimer, the term of this patent is extended or adjusted under 35 U.S.C. 154(b) by 0 days.

(21) Appl. No.: 09/390,657

(22) Filed: Sep. 7, 1999

(51) Int. Cl.[7] ..... A47L 13/16
(52) U.S. Cl. ..... 15/244.4; 15/244.1; D32/40
(58) Field of Search ..... 15/244.1, 244.3, 15/244.4; D32/40

(56) References Cited

U.S. PATENT DOCUMENTS

D. 356,408 * 3/1995 Adolf ..... D32/40
1,884,659 * 10/1932 Gould ..... D32/40 X
2,030,911 * 2/1936 Borden ..... 15/244.1 X
2,319,873 * 5/1943 Linz ..... 15/244.4
2,555,858 * 6/1951 Olesky ..... 15/244.1
2,841,811 * 7/1958 Carroll ..... 15/244.1
3,570,036 * 3/1971 Gilchrist et al. ..... 15/244.1 X
4,030,414 * 6/1977 McGuire ..... 15/244.4 X
4,627,129 * 12/1986 Wittes ..... 15/244.4
4,866,806 * 9/1989 Bedford ..... 15/244.4 X
5,791,008 * 8/1998 Crabtree ..... 15/244.1

* cited by examiner

*Primary Examiner*—Mark Spisich
(74) *Attorney, Agent, or Firm*—Oblon, Spivak, McClelland, Maier & Neustadt, P.C.

(57) ABSTRACT

A sponge with a sponge body and at least two slots formed in the sponge body to respectively receive the fingers and thumbs of a user. Relief portions may also be formed at each of the first and second slots. As a further feature, inserts can be formed in each of the first and second slots, which inserts may be formed of plastic, a further sponge material, etc. The sponge body may also include a cap area so that the overall sponge body has a mushroom shape. The sponge body can be formed of any acceptable material, such as a uretane based material, a cellulose based material, etc.

6 Claims, 2 Drawing Sheets

SPONGE WITH GRIPPING SLOTS

BACKGROUND OF THE INVENTION

1. Field of the Invention

The present invention is directed to a sponge, which for example may find use in a household chore or vehicle cleaning application, which includes gripping slots to receive a hand of the sponge user to enhance the gripping of the sponge by the user.

2. Discussion of the Background

Sponges find use in many applications, such as in household cleaning chores, washing a car, etc. In these uses the sponges of course become wet. As the sponges become wet, they become more difficult to grip.

SUMMARY OF THE INVENTION

Accordingly, one object of the present invention is to provide a novel sponge with a structure which improves gripping ability by a user when the sponge is used, to thereby make the sponge easier to use.

A further object of the present invention is to provide a novel sponge in which the structure of the sponge to enhance the gripping ability of the sponge is simple and inexpensive to manufacture into the sponge.

A further object of the present invention is to provide a novel sponge in which the structure of the sponge to enhance the gripping ability of the sponge does not reduce the durability of the sponge.

The present invention achieves these and other objects by providing a novel sponge with a sponge body and at least two slots formed in the sponge body to respectively receive the fingers and thumbs of a user. Further, relief portions may be formed at each of the first and second slots. As a further feature of the present invention, inserts can be formed in each of the first and second slots, which inserts may be formed of plastic, a further sponge material, etc. The sponge body may also include a cap area so that the overall sponge body has a mushroom shape. The sponge body can be formed of any acceptable material, such as a urethane based material, a cellulose based material, etc.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1A:
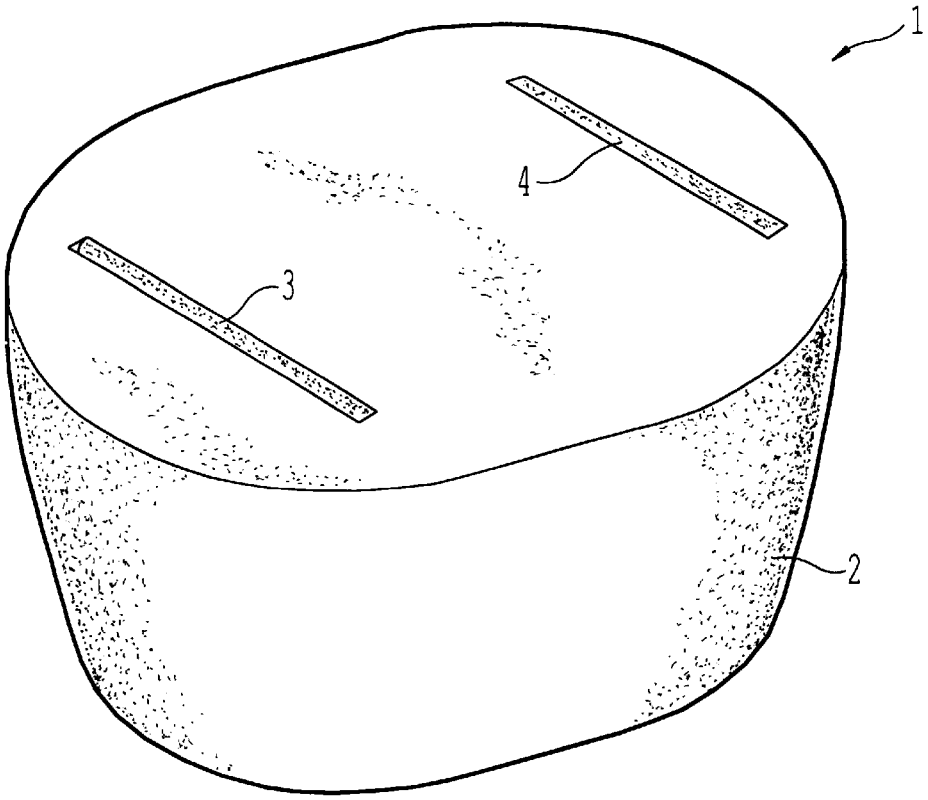
FIG. 1A shows a perspective view of a first embodiment of the sponge of the present invention.
Figure 1B:
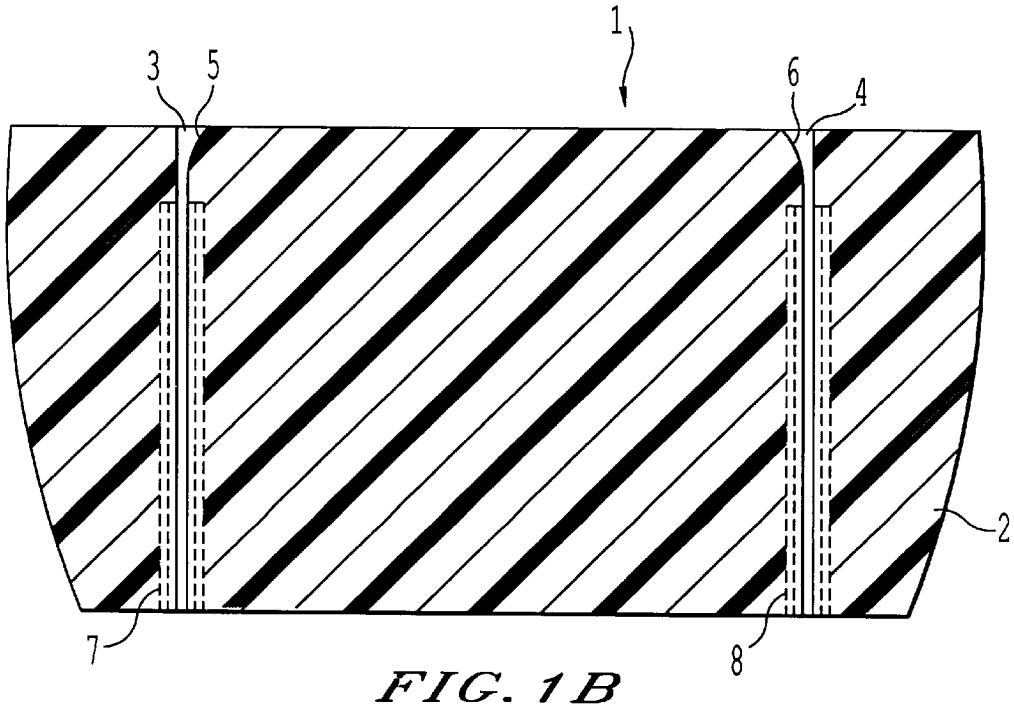
FIG. 1B shows a cross-sectional view of the sponge of FIG. 1.

Referring now to the drawings, wherein like reference numerals designate identical or corresponding parts throughout the several views, and more particularly to FIGS. 1A and 1B thereof, perspective and cross-sectional views of the sponge 1 of the present invention are set forth. As shown in FIG. 1, the sponge 1 of the present invention includes a sponge body 2. In the embodiment shown in FIG. 1 the sponge body 2 is a three-dimensional oval which is not die cut. The sponge body 2 can take on other shapes and is clearly not limited to the three-dimensional oval shape shown in FIG. 2. Moreover, the sponge body 2 can be formed of any appropriate sponge material including, but not limited to, a urethane based sponge material, a cellulose based sponge material, etc.

As also shown in FIG. 1, on one face of the sponge body 2, shown in FIG. 1 as the top face, two slots 3 and 4 are formed. The slots 3 and 4 extend into the sponge body 2 and are designed to respectively receive the four fingers and the thumb of a user. By incorporating the slots 3 and 4 into the one face of the sponge body 2, a user can insert his or her fingers into the slot 3 and his or her thumb into the slot 4, and can thereby get a good grip on the sponge body 2. The depth of the slots 3 and 4 in the sponge body 2 can vary but should be deep enough to allow a good gripping by a user.

As also shown in FIG. 1, the sides of the slots 3 and 4 include respective relief portions 5 and 6, shown most clearly in FIG. 1B. The relief portions 5 and 6 are tapered reliefs which extend from the respective slots 3, 4 towards the center of the sponge body 2 a short distance, for example on the order of 5 mm. The relief portions 5 and 6 provide at least two benefits. A first benefit of the relief portions 5 and 6 is that as they are angled towards the center of the sponge body 2, which is towards the center of a user's hand, and thus the relief portions 5 and 6 make the user's fingers and thumb in the slots 3 and 4 more comfortable. A second benefit achieved by the relief portions 5 and 6 is that they make the slots 3 and 4 more visible. Without the relief portions 5 and 6 it may be difficult for a user to even know that the sponge body 2 contains the slots 3, 4 and to locate the slots 3, 4.

Thus, with the novel sponge 1 shown in FIG. 1 a user can securely grip the sponge body 2, which thereby enhances the usability of the sponge 1, when the user is using the sponge 1 for household chores, washing their car, etc. Further, the slots 3 and 4 are simple in design, and thus can be formed by any well known simple manufacturing process.

An optional feature of the sponge 1 of FIG. 1 is shown particularly in FIG. 1B. The sponge shown in FIG. 1B additionally shows that inserted within each of the slots 3 and 4 are respective inserts 7 and 8. The inserts 7 and 8 are provided to enhance the durability of the sponge around the slots 3 and 4. More particularly, as a user inserts his or her fingers and thumb into the slots 3 and 4, the user will rub the sides of the slots 3 and 4, and may poke his or her fingers and thumb into the bottom of the slots 3 and 4. Further, the user can use the slots 3 and 4 to squeeze the sponge body 2 to release water therefrom. Each of those actions may result in the sponge material within the slots 3 and 4 becoming worn out. To prevent wearing out of the sponge material within the slots 3 and 4, inserts 7 and 8 can be provided in the slots 3 and 4. The inserts 7, 8 can take several forms. One simple form of the inserts 7 and 8 may be as plastic inserts which fit into the slots 3 and 4 and into which the user inserts his or her fingers and thumb. That form of the inserts 7 and 8 would be similar to a "pocket protector" inserted into a shirt pocket. Another form that the inserts 7 and 8 can take on is of an additional sponge material inserted into the slots 3, 4 or simply placed on the bottom of the slots 3 and 4. That sponge material may be the same material as the sponge body 2 or may be of a stronger sponge material than the sponge body 2, i.e. a sponge material which is made of a stronger material, which has a greater density, etc. If such sponge inserts 7 and 8 are provided in the slots 3 and 4, that would also inhibit the bottom of the slots 3 and 4 from wearing out. The inserts 7 and 8 can also be replaced if they wear out.

Figure 2:
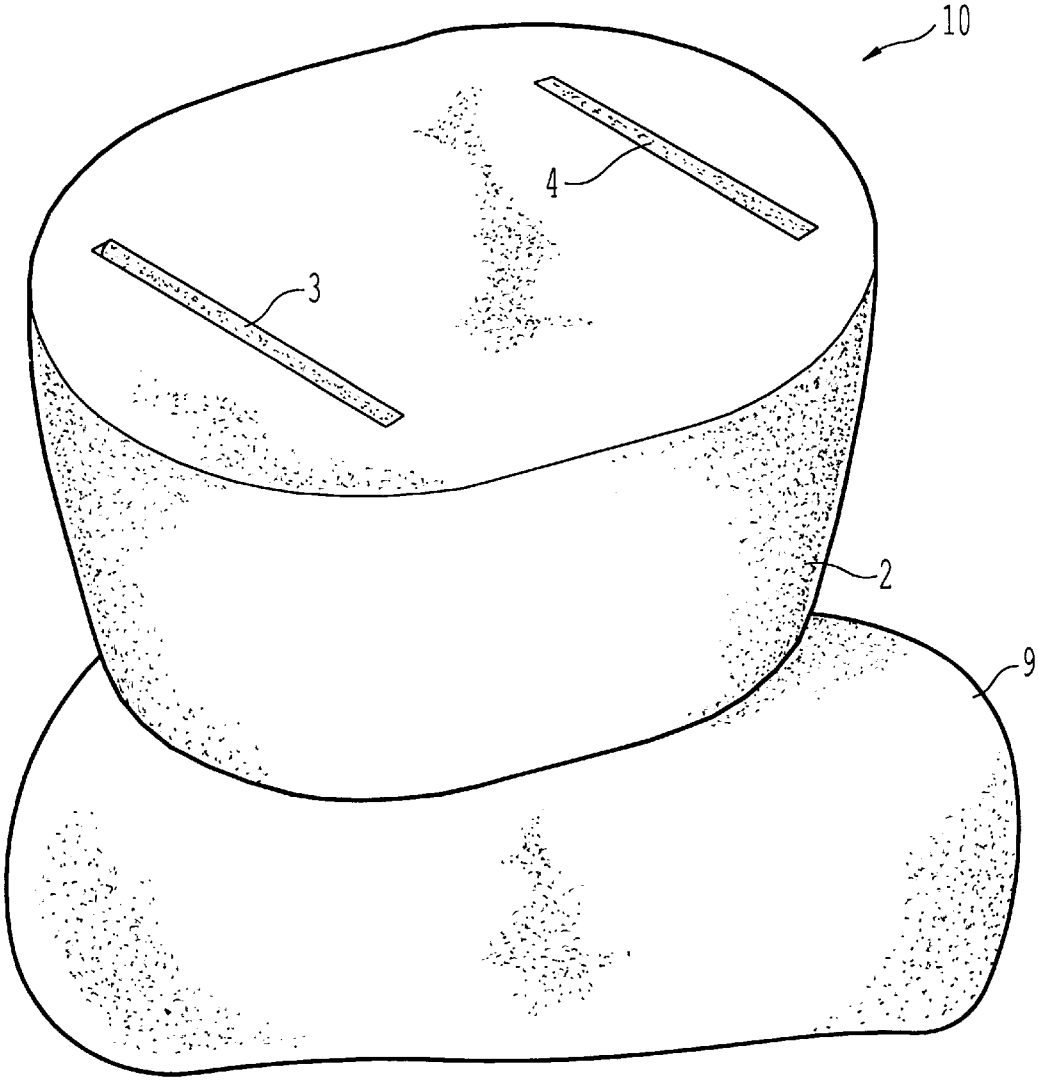
FIG. 2 shows a modification of the sponge of FIG. 1.

FIG. 2 shows a further modification of the sponge of FIG. 1. The sponge 10 shown in FIG. 2 provides an extra cap portion 9 to the sponge body 2. The use of the cap portion 9 provides the sponge with an overall "mushroom" type shape. The cap portion 9 can be formed of the same material as the sponge body 2 and can merely be an extension of the sponge body 2, i.e. the sponge body and the cap portion 9 can be formed of a unitary sponge material. The cap portion 9 provides the benefits of providing a larger surface area to the sponge. Further, if a user is tightly gripping the sponge body 2, that may result in a slight deformation on the face of the sponge body 2 opposite the face including the entry points of the slots 3 and 4. By utilizing the cap portion 9, even if the user tightly grips the sponge body 2 through the slots 3, 4 the surface of the cap portion 9 would not be deformed.

Obviously, numerous additional modifications and variations of the present invention are possible in light of the above teachings. It is therefore to be understood that within the scope of the appended claims, the present invention may be practiced otherwise than as specifically described herein.

What is claimed is:

1. A sponge comprising a sponge body;

first and second slots formed in the sponge body and spaced to respectively receive fingers and a thumb of a user of the sponge;

inserts formed in each of the first and second slots.

2. A sponge according to claim 1, wherein the inserts are formed of plastic.

3. A sponge according to claim 1, wherein the inserts are formed of sponge material stronger than a sponge material of the sponge body.

4. A sponge comprising:

a sponge body;

first and second slots formed in the sponge body and spaced to respectively receive fingers and a thumb of a user of the sponge;

relief portions formed at each of the first and second slots; and inserts formed in each of the first and second slots.

5. A sponge according to claim 4, wherein the inserts are formed of plastic.

6. A sponge according to claim 4, wherein the inserts are formed of sponge material stronger than a sponge material of the sponge body.

* * * * *